US006199834B1

(12) United States Patent
Popov et al.

(10) Patent No.: US 6,199,834 B1
(45) Date of Patent: Mar. 13, 2001

(54) OPERATION METHOD FOR A GAS-LIQUID EJECTOR

(76) Inventors: Serguei A. Popov, 4615 Post Oak Pl., Suite 140, Houston, TX (US) 77027; Anatoli M. Doubinski, Flat 96, 6, Volokolamskoe Shosse, Moscow, 125080 (RU)

( * ) Notice: Subject to any disclaimer, the term of this patent is extended or adjusted under 35 U.S.C. 154(b) by 0 days.

(21) Appl. No.: 09/242,402

(22) PCT Filed: Jun. 8, 1998

(86) PCT No.: PCT/IB98/00888

§ 371 Date: Feb. 16, 1999

§ 102(e) Date: Feb. 16, 1999

(87) PCT Pub. No.: WO98/58175

PCT Pub. Date: Dec. 23, 1998

(30) Foreign Application Priority Data

Jun. 16, 1997 (RU) ..... 97109381

(51) Int. Cl.[7] ..... B01F 3/04
(52) U.S. Cl. ..... 261/76; 261/DIG. 75
(58) Field of Search ..... 261/76, DIG. 75; 239/338, 428.5; 417/158

(56) References Cited

U.S. PATENT DOCUMENTS

| | | | | |
|---|---|---|---|---|
| 2,207,390 | * | 7/1940 | White | 261/76 |
| 2,223,237 | * | 11/1940 | Cooke | 261/76 |
| 3,655,343 | * | 4/1972 | Galeano | 261/76 |
| 3,761,065 | * | 9/1973 | Rich et al. | 261/76 |
| 3,938,738 | * | 2/1976 | Nagel et al. | 261/DIG. 75 |
| 4,634,560 | * | 1/1987 | Eckert | 261/76 |
| 6,019,820 | * | 2/2000 | Leverett | 261/76 |

FOREIGN PATENT DOCUMENTS

| | | |
|---|---|---|
| 2016268 | 7/1994 | (RU) . |
| 2050168 | 12/1995 | (RU) . |
| 559098 | 7/1977 | (SU) . |
| 1195074 | 11/1985 | (SU) . |
| 1588925 | 8/1990 | (SU) . |
| 1733714 | 5/1992 | (SU) . |

* cited by examiner

*Primary Examiner*—C. Scott Bushey
(74) *Attorney, Agent, or Firm*—Mark A. Oathout

(57) ABSTRACT

The invention pertains to the field of jet technology and essentially relates to a method of operation including discharge of a motive liquid from a nozzle of a liquid-gas ejector, mixing of the motive liquid with an evacuated gaseous medium and simultaneous compression of the gaseous medium, collecting of the sprayed part of the motive liquid flow with further discharge of this collected liquid from the ejector by gravity or using a pumping action. This operational method for a liquid-gas ejector provides an increased efficiency factor for the ejector.

3 Claims, 1 Drawing Sheet

OPERATION METHOD FOR A GAS-LIQUID EJECTOR

TECHNICAL FIELD

This invention pertains to the field of jet technology, primarily to devices for evacuation or compression of gaseous mediums.

BACKGROUND

An operational method of a liquid-gas ejector is known, which includes feeding of a motive liquid under pressure into the ejector's nozzle, discharge of the motive liquid from the nozzle and evacuation of a gaseous medium by the motive liquid (see SU, certificate of authorship, 1195074, cl. F 04 F/54,1985).

This method allows evacuation of various gases by a motive liquid circulating in a closed loop. But this method does not provide complete and effective utilization of the energy of the motive liquid, which reduces effectiveness of liquid-gas ejector's operation.

The closest analogue of the method introduced in the present invention is a method of operation of a liquid-gas ejector, which includes feeding of a motive liquid under pressure into the ejector's nozzle, discharge of the motive liquid from the nozzle, evacuation of a gaseous medium by the motive liquid, mixing of the two mediums with simultaneous partial transfer of kinetic energy from the motive liquid to the evacuated gaseous medium and consequent compression of the gaseous medium, forming of a gas-liquid mixture and its further discharge from the ejector (see RU, patent 2016268, cl. F 04 F 5/54,1994).

The above described operational method of a liquid-gas ejector provides evacuation of various gaseous mediums, generation of a vacuum in an evacuated reservoir and compression of the evacuated gaseous medium. However, this method is characterized with rather big losses of energy of the motive liquid because of irrational energy transfer at the initial stage of interaction between the motive liquid and evacuated gaseous medium.

SUMMARY OF THE INVENTION

The present invention is aimed at an increase of the efficiency factor of a liquid-gas ejector by reducing losses of energy of the ejectors motive liquid.

The recited problem is solved as follows. An operational method for a liquid-gas ejector, which includes feeding of a motive liquid into the ejector's nozzle, discharge of the motive liquid from the nozzle, evacuation of a gaseous medium by the motive liquid, mixing of the two mediums with simultaneous partial transfer of kinetic energy from the motive liquid to the evacuated gaseous medium and consequent compression of the gaseous medium, forming of a gas-liquid mixture and its further discharge from the ejector, is modified so that after discharge from the nozzle the peripheral part of the motive liquid flow is separated from the main flow, collected and discharged from the ejector in order to prevent penetration of the collected portion of the motive liquid into a mixing chamber of the ejector.

The collected portion of the motive liquid can be discharged from the ejector by gravity or using a pumping action.

Experimental research into operation of liquid-gas ejectors showed, that during discharge of a motive liquid from the ejector's nozzle (no matter whether single-channel or multi-channel), the peripheral part of the motive liquid flow consisting mainly of fine drops loses kinetic energy much faster than the remaining part of the liquid flow while coming into contact with an evacuated gas. In fact this peripheral portion of the motive liquid becomes a medium to be evacuated. While hitting with molecules of the evacuated gas, the peripheral part of the liquid flow is sprayed in a receiving chamber and settles on the walls of its downstream section. The sprayed portion of the motive liquid streams down under gravity and under influence of the gas flow and is accumulated in the receiving chamber. As the sprayed portion accumulates, it starts to flow into the mixing chamber. If the ejector is placed horizontally the accumulated portion of the motive liquid is also able to penetrate the pipeline, through which the evacuated gaseous medium flows into the ejector. If the motive liquid collected in the receiving chamber enters the mixing chamber the energy of non-sprayed part of the motive liquid flow is consumed not only for evacuation of the gaseous medium, but also for pumping of this "passive" portion of the motive liquid through the ejector's flow-through channel. All of this negatively affects performance of the ejector.

Penetration of the "passive" portion of the motive liquid into the gas supply pipeline results in encountering a higher hydraulic resistance in this pipeline, such that extra energy consumption is required to overcome this additional resistance.

Collecting of the sprayed peripheral part of the motive liquid flow in a special cavity arranged in the ejector's receiving chamber and following discharge of the collected liquid from the receiving chamber prevents ingress of the "passive" motive liquid into the mixing chamber or into the gas supply pipeline and eliminates its negative influence on performance of the liquid-gas ejector.

Depending on the mode of the ejector's operation and its position (horizontal or vertical, the ejector's height relative to the other elements of the system), there are two variants for discharge of the motive liquid accumulated in the receiving chamber—by gravity or using a pumping action. The discharge by gravity is possible for the most part when the liquid-gas ejector is used for producing a vacuum, because in this case a barometric pipe can be used as the drain pipe for discharge of the accumulated liquid. If the liquid-gas ejector is used for other purposes (for example for gas compression), it is preferable to pump out the motive liquid collected in the receiving chamber.

BRIEF DESCRIPTION OF DRAWINGS

The drawing in FIG. 1 represents a schematic diagram of a liquid-gas ejector implementing the described operational method.

DETAILED DESCRIPTION

Figure 1:
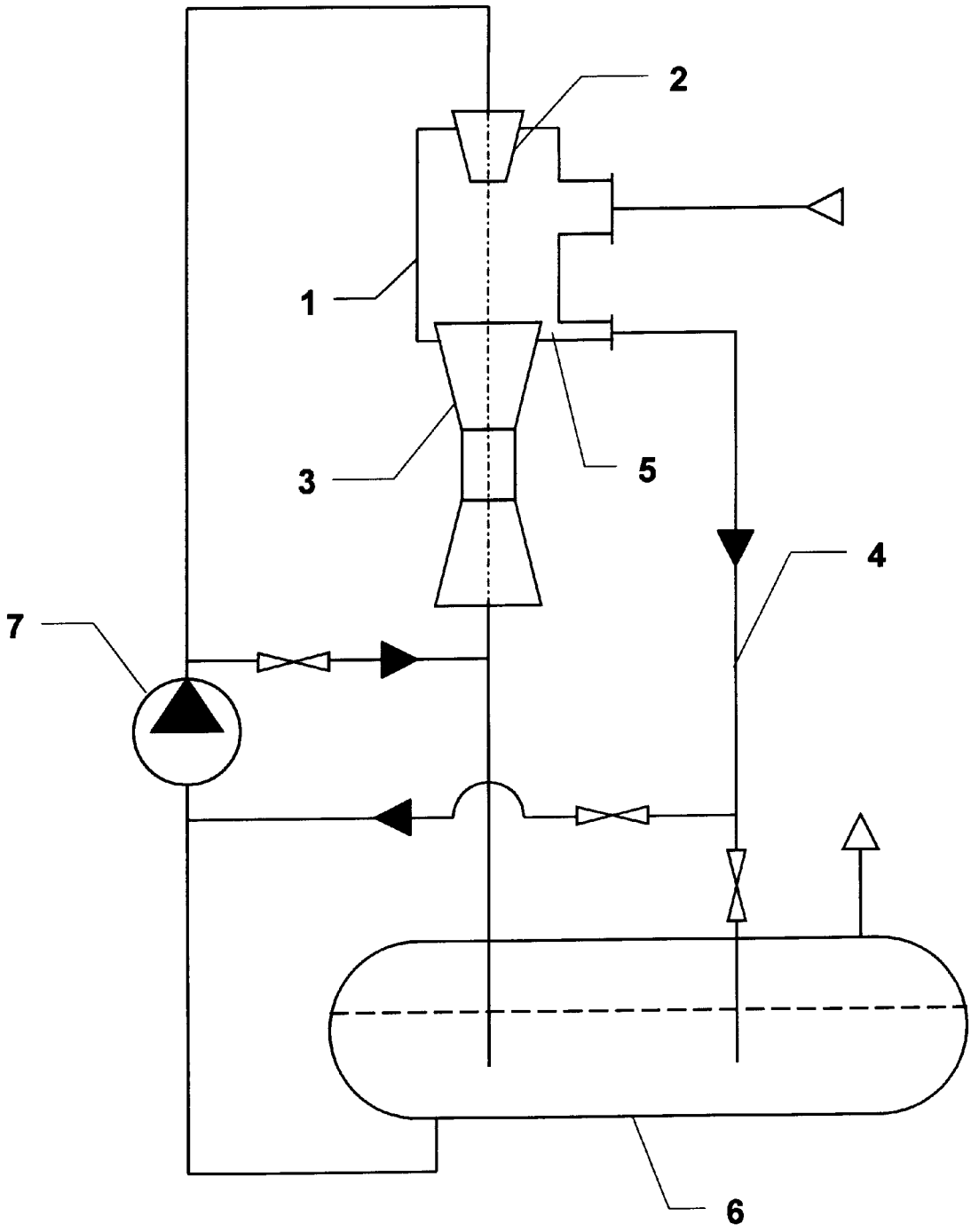

The liquid-gas ejector comprises a receiving chamber 1, a nozzle 2, a mixing chamber 3, a drain line 4, a cavity 5, where the sprayed peripheral part of the motive liquid flow is collected before discharge. The cavity 5 can be formed by the wall of the inlet section of the mixing chamber 3 and walls of the downstream section of the receiving chamber 1. The motive liquid collected in the cavity 5 can be discharged from the receiving chamber 1 into a separator 6, receiving a gas-liquid flow from the ejector. Forced evacuation of the motive liquid from the cavity 5 of the receiving chamber 1 can be effected by a pump 7, which feeds the motive liquid under pressure into the ejector's nozzle 2.

The liquid-gas ejector implements the operational method as follows.

A motive liquid is fed under pressure from the separator 6 into the nozzle 2 of the liquid-gas ejector by the pump 7. The motive liquid flowing from the nozzle 2 entrains an evacuated gaseous medium from the receiving chamber 1 to the mixing chamber 3. In the mixing chamber 3 a mixture of the motive liquid and evacuated gaseous medium is transformed into a gas-liquid flow, at the same time compression of the gaseous medium takes place. Then the gas-liquid mixture is discharged from the ejector and flows to its destination, for example to the separator 6 where the motive liquid is separated from the compressed evacuated gas. Simultaneously, during discharge from the nozzle 2 the peripheral part of the motive liquid flow is partially sprayed in the receiving chamber 1 because of its interaction with the evacuated gaseous medium. Then the sprayed portion of the motive liquid is accumulated gradually in the downstream section of the receiving chamber 1, where the collecting cavity 5 is formed. In case of a vertical or nearly vertical position of the ejector the sprayed portion of the motive liquid is accumulated in the cavity 5 at the inlet section of the mixing chamber 3. The wall of the inlet section of the mixing chamber 3 forming the cavity 5 in the receiving chamber 1 prevents penetration of the sprayed portion of the motive liquid into the mixing chamber 3. Finally the sprayed portion of the motive liquid collected in the cavity 5 flows into the drain line 4. Subject to the mode of the ejector's operation, the liquid is discharged from the cavity 5 through the drain line 4 into the separator 6 by gravity or is evacuated from the cavity 5 by the pump 7.

Thus, collecting of the sprayed peripheral part of the motive liquid flow in the receiving chamber and subsequent discharge of this liquid from the ejector provide an increase in the efficiency of the ejector due to a more rational utilization of energy of ejector's motive liquid.

INDUSTRIAL APPLICABILITY

The invention can be applied in chemical, petrochemical and some other industries.

What is claimed is:

1. An improved operational method for a liquid-gas ejector, where the operational method includes feeding a motive liquid under pressure into a nozzle, discharging the motive liquid from the nozzle, evacuating a gaseous medium by the motive liquid, mixing the motive liquid and the evacuated gaseous medium in a mixing chamber, partially transferring kinetic energy from the motive liquid to the evacuated gaseous medium, compressing the gaseous medium, forming a gas-liquid mixture in the liquid-gas ejector and discharging the gas-liquid mixture from the liquid-gas ejector, comprising:

collecting a peripheral part of the motive liquid flow after discharge of the motive liquid from the nozzle; and discharging the collected peripheral part of the motive liquid from the liquid-gas ejector prior to penetration of the collected peripheral part of the motive liquid into the mixing chamber.

2. The method according to claim 1, wherein said step of discharging the collected peripheral part of the motive liquid is performed by gravitationally forcing the collected peripheral art of the motive liquid from the liquid-gas ejector.

3. The method according to claim 1, wherein said step of discharging the collected peripheral part of the motive liquid is performed by evacuating by pumping the collected peripheral part of the motive liquid from the liquid-gas ejector.

* * * * *